US005272510A

United States Patent [19]

Reese et al.

[11] Patent Number: 5,272,510

[45] Date of Patent: Dec. 21, 1993

[54] ENHANCED TONER RECLAIM METHOD AND APPARATUS FOR A PLURAL COLOR XEROGRAPHIC SYSTEM

[75] Inventors: William P. Reese, Pittsford; Sharon B. Hiergesell, Penfield, both of N.Y.

[73] Assignee: Xerox Corporation, Stamford, Conn.

[21] Appl. No.: 976,180

[22] Filed: Nov. 13, 1992

[51] Int. Cl.[5] ..... G03G 21/00

[52] U.S. Cl. ..... 355/298

[58] Field of Search ..... 355/296, 298; 118/652

[56] References Cited

U.S. PATENT DOCUMENTS

| | | | |
|---|---|---|---|
| 3,678,896 | 7/1972 | Hewitt | 355/298 X |
| 3,724,020 | 4/1973 | Till | 15/256.53 |
| 3,788,454 | 1/1974 | Emerson | 198/168 |
| 4,030,824 | 6/1977 | Smith | 355/298 |
| 4,494,863 | 1/1985 | Laing | 355/302 |
| 5,132,740 | 7/1992 | Okamoto et al. | 355/298 |

FOREIGN PATENT DOCUMENTS

| | | | |
|---|---|---|---|
| 54-113340 | 4/1979 | Japan | 355/298 |
| 57-161769 | 10/1982 | Japan | 355/298 |
| 59-147375 | 8/1984 | Japan | 355/298 |
| 59-148080 | 8/1984 | Japan | 355/298 |
| 62-9383 | 1/1987 | Japan | 355/298 |
| 62-105176 | 5/1987 | Japan | 355/298 |

*Primary Examiner*—Fred L. Braun

[57] ABSTRACT

In a plural color printer or copier in which marking materials (e.g., toner) of at least first and second different colors are utilized, especially where the first color is the most commonly used (normally, black), with a common cleaning system for removing marking materials not fully utilized for imaging; an automatically actuated gate system selectively connects the cleaning system via a transport path to a purging dump, or, connects the cleaning system to a toner reclaim path to the image development station using that toner. The gate system is maintained in the purging position when the printer or copier is utilizing any marking material of the second or other colors. The gate is maintained in the reclaim position when the printer or copier is solely utilizing the first marking material. There is also a preset purge cycle delay of the actuation of the gate following from whenever the printer or copier starts solely utilizing the first marking material of the first color, i.e., delaying gate actuation until after a copy count or preset fixed time period has expired which was preset to be sufficient to remove mixed (plural colors) toner from the cleaning and upstream toner transport system. This purge delay effectively prevents any deleterious amount of mixed toners from passing through the reclaim path to the first image development station. (This preset delay will be a function of the cleaning and transport system geometry and size of the particular copier.)

8 Claims, 2 Drawing Sheets

Figure 1:
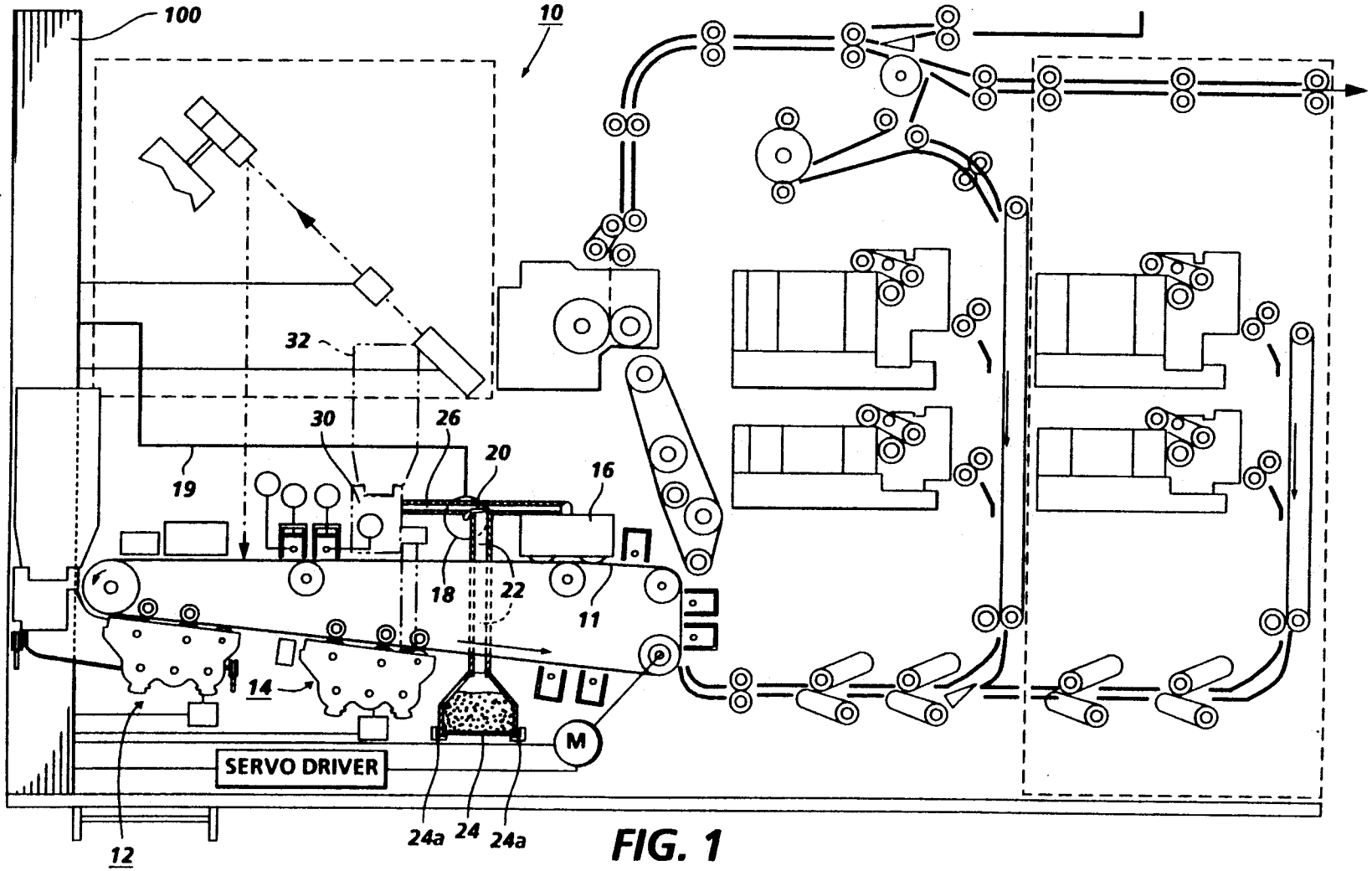

ENHANCED TONER RECLAIM METHOD AND APPARATUS FOR A PLURAL COLOR XEROGRAPHIC SYSTEM

A system enabling separate recovery and reuse of developer material in a plural color, plural developer material, imaging system. For example, [but not limited thereto] in a xerographic copier or printer which provides highlight or full color imaging in addition to normal black-only imaging, a system for reclaiming black toner recovered at the cleaning station to return that toner to the black toner development station without significant contamination with other colored toner even though one or more other developer units with such other colored toner are also cleaned by the same cleaning station from the same imaging surface in other operating modes of the same copier or printer.

There is also disclosed herein a low cost and simple automatic system for purging the cleaning system and enabling reuse of one developer material even though the reproduction apparatus alternatively uses other developer materials.

Various types of "toner reclaim" systems for conventional single color (black toner only) xerographic copiers are known in the art. The following patent disclosures are noted as early examples: Xerox Corporation U.S. Pat. Nos. 3,678,896, issued Jul. 25, 1972 to R. E. Hewitt; 3,724,020, issued Apr. 3, 1973 to H. R. Till; 3,788,454, issued Jan. 29, 1974 to W. C. Emerson; and subsequent patents citing these patents. These systems continuously recycle for reuse within the copier the same single toner all of the time. They do not have the problems of plural-color machines, in which one developer material can contaminate and render non-reusable another developer material.

However, in the future, many printers and copiers with significant toner usage, such as medium or large (high-speed) reproduction machines, will want to have both highlight or full process color and at least black toner reclaim. Toner reclaim may even become mandatory in some countries. The system taught herein is applicable to almost any highlight or plural-color copier or printer.

One example of such a modern commercial 2-color, high-production highlight color printer is schematically illustrated herein; the Xerox Corporation "4850". However, it does not presently provide toner reclaim.

The problem is that presently one cannot easily recover or reclaim toner (for immediate reuse in the machine) in machines where the cleaning system recovers mixed toners. Thus, normally all the toners of all colors in such machines are simply purged and dumped, not recycled. Thus, there is substantially increased customer toner consumption when any highlight color system feature is added to a machine, even if that highlight color feature is rarely used.

This increased new toner consumption (copies made per replacement unit of toner) and increased cost to customers therefrom, in converting from black-only copiers or printers with toner reclaim, to optional color copiers or printers without toner reclaim, is clearly undesirable. However, as noted, this is presently unavoidable with most plural-color copiers or printers, due to colored toner contamination in the cleaner effluent precluding use of even a black toner reclaim system. Even if two or more separate cleaning systems might avoid intermixing used toners, that would undesirably require considerable increased expense and space (and might still not work). In contrast, the use of the present system can significantly decrease new toner consumption per copy in such plural-color machines with little additional hardware or expense.

Even in plural-color machines, often the most frequent operating mode is with only one developer material (one color of toner-normally black). The vast majority of original business documents or electronic images are black and white only images. For this reason, and/or to provide true solid black images without color fringes, even full (3-color) color machines often provide a black developer as a 4th color.

Further by way of background, one example of a removable waste toner sump or dump collecting device is disclosed in U.S. Pat. No. 5,132,740, issued Jul. 21, 1992 to K. Okamoto, et al.

One example of a system for toner contaminants removal is taught by Xerox Corporation U.S. Pat. No. 4,494,863, issued Jan. 22, 1985 to J. R. Laing. Said 4,494,863 merely teaches electrical separation of toner from paper lint, Kaolin contaminants and reversed-sign toner, for continuously capturing a single (cleaned) toner, and does not mention plural or colored toners, or their problems or how to separate them. This disclosure is of interest, however, as disclosing an additional optional feature which can be provided in any toner reclaim system, including the present one.

A specific feature of the specific embodiment disclosed herein is to provide, in a plural-color printer or copier imaging apparatus in which least two different marking materials of at least first and second respective colors are respectively utilized for said imagings in at least first and second distinct image development stations, and wherein said imaging apparatus also includes a cleaning system for removing said marking material which are not fully utilized for said imaging, and a purging dump into which said marking materials removed by said cleaning system may be collected, and a transport path for transporting said marking materials between said cleaning system and said purging dump, the improvement comprising: an automatically actuatable marking materials gate system operatively connecting with said cleaning system and said transport path to said purging dump, control means for said actuation of said gate system, a marking materials reclaim path operatively connecting between said gate system and said first image development station, said gate system being selectably actuatable by said control means between at least a first gate position diverting said marking materials from said cleaning system into said reclaim path to said first image development station, and a second gate position directing said marking materials from said cleaning system into said transport path to said purging dump, said control means maintaining said gate system in said second gate position when said imaging apparatus is utilizing said second marking material of said second color from said second image development station, and maintaining said gate system in said first gate position when said imaging apparatus is utilizing said first marking material of said first color from said first image development station, said control means having a purge cycle delay for delaying said actuation of said gate system from said second gate position to said first gate position for a preset delay period after said imaging apparatus is utilizing said first marking material of said first color from said first image development station, said preset delay period being sufficient to substantially purge said second marking material of said second color and to substantially prevent said second marking material of said second color from passing through said marking materials reclaim path to said first image development station.

Further specific features provided by the system disclosed herein, individually or in combination, include those wherein said first marking material is black; and/or in which said preset gate actuation purge cycle delay period of said control means corresponds to a preset time period or a preset number of said imagings by said first image development station.

An additional disclosed feature is in a method of plural color imaging with a plural-color imaging apparatus in which at least two different marking materials of at least first and second respective colors are respectively utilized for said imagings in at least first and second image development stations, and wherein a common cleaning system captures said marking materials which are not utilized for said imagings, the improvement comprising: selectably gating said marking materials from said cleaning system into a purging path or into a reclaim path to return said marking materials to said first image development station, including maintaining said gating of marking materials into said purging path when said imaging apparatus is utilizing said second marking material of said second color from said second image development station, further including maintaining said gating of marking materials into said reclaim path when said imaging apparatus is solely utilizing said first marking material of said first color from said first image development station, and controlling said gating to provide a purge cycle delay for delaying said gating from said purging path to said reclaim path for a preset delay period after said imaging apparatus begins solely utilizing said first marking material of said first color from said first image development station, said preset delay period being sufficient to substantially purge said second marking material of said second color into said purging path, and to prevent deleterious amounts of said second marking material of said second color from entering said reclaim path to said first image development station.

As to specific hardware components of the subject apparatus, it will be appreciated that, as is normally the case, some such specific hardware components are already known per se in other apparatus or applications, and thus need not be described herein. For example, the cited and other patents (including later patents citing those patents) teach various toner transports, conduits, etc., which may be utilized with the system of the invention.

The disclosed apparatus may be readily operated and controlled utilizing conventional control systems already known and commercially available. Some examples of various prior art copiers with control systems therefor, are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in general and preferable to program and execute such control functions and logic with conventional software instructions for conventional microprocessors. This is taught by the above and other patents and various commercial copiers. Such software may of course vary depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hard-wired logic or switching systems. The resultant controller signals may conventionally actuate conventional electrical solenoid or cam-controlled deflector fingers, motors or clutches in the copier or printer in the selected steps or sequences as programmed.

All references cited in this specification, and their references, are incorporated by reference herein where appropriate for appropriate teachings of additional or alternative details, features, and/or technical background.

Figure 2:
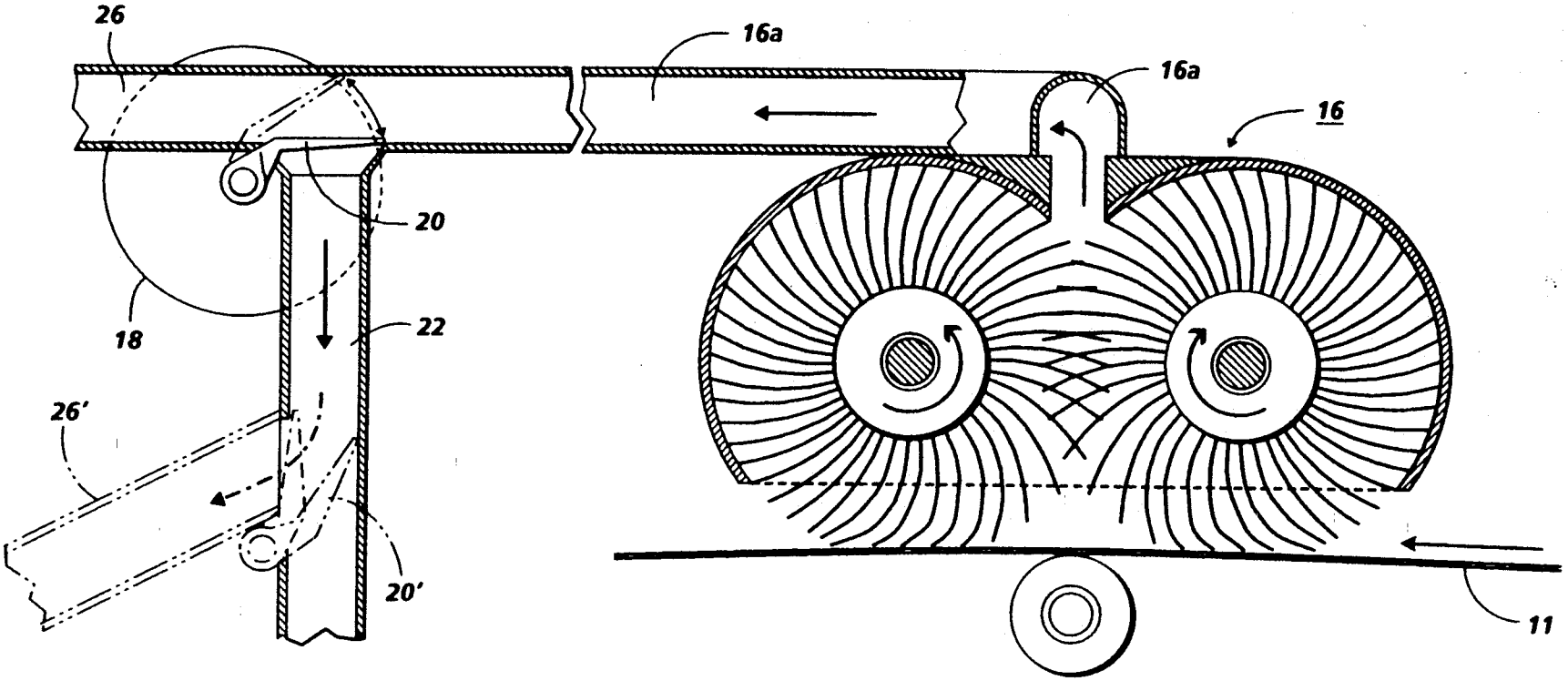

Various of the above-mentioned and further features and advantages will be apparent from the specific apparatus and its operation described in the examples below, as well as the claims. Thus, the present invention will be better understood from this description of an embodiment thereof, including the drawing figures (approximately to scale) wherein:

FIG. 1 is a schematic front view of one embodiment of the present enhanced toner reclaim and purging system installed in a known, exemplary plural color reproduction apparatus; and FIG. 2 is an enlarged cross-sectional front view of the cleaning system of FIG. 1 and the associated controlled gated toner reclaim and purging system disclosed herein.

Describing now in further detail this exemplary embodiment with reference to the Figures, there is shown a known reproducing machine 10 by way of one example of a plural color printer (or copier) with which the present developer material reclaim and purging system may be utilized. Further details of the exemplary printer 10, which in this example is (schematically) the Xerox Corporation "4850" Highlight Color Laser Printing System, may be seen from, e.g., Xerox Corporation U.S. Pat. No. 5,144,369, issued Sep. 1, 1992 to L. R. Benedict, et al., and Xerox Corporation U.S. Pat. No. 4,811,046 and 4,847,655, cited therein.

The disclosed embodiment provides a gated toner reclaim versus dumping selection system. The toner gate is controlled by machine software in the existing machine controller so that reclaim recycling of black toner back to the black developer unit [versus dumping] is normally selected, by gating the photoreceptor cleaner output into a reclaim loop for machine reuse of the black toner whenever the machine is in a black-only imaging mode. However, and very importantly, this is further restricted by delaying this until after a preset number [e.g., 3–6] of black-only copies have been made [sufficient to purge the cleaning system of the previously used colored toner]. The toner gate is oppositely actuated to deflect and dump the [colored or mixed] toner into a purge or dump container for removal during color imaging operations, and also for said purge cycle.

As shown in FIG. 1, and partially shown enlarged in FIG. 2, latent images on the photoreceptor 11 are conventionally developed by various known (but different) developer materials from either a developer station 12 or a developer station 14, in this example. [In a full color machine, there may be three or four such developer units.] Here, the developer station 14 contains black toner, and the developer station 12 (which is interchangeable, as described in the above cited U.S. Pat. No. 5,144,369) contains a selected colored toner, such as red toner. All used toner not transferred to copy sheets in the reproduction apparatus 10 may be conventionally recovered from the photoreceptor imaging surface 11 by a conventional cleaning system 16 (here, comprising two counter-rotating cleaning brushes). [See, e.g., Xerox Corporation U.S. Pat. Nos. 5,128,725 or 5,031,000.] The cleaning station 16 here ejects all recovered toner from its outlet 16*a*.

The control of which (or both) developer units 12 or 14 are being used to develop images on the photoreceptor 11 for any given image or set of images is conventional and well known. E.g., changing the electrical bias on the respective developer rollers, as controlled by the controller 100. Thus, the particular toner or toners to be (and being) used is already known in the controller 100.

No particular vacuum or negative air pressure supply is shown for the illustrated brush cleaning system 16 and/or the developer units 12, 14, since that is well known and conventional. Also, if desired, a conventional air blower vacuum connected cyclone separator may be provided at the output 16*a* of the cleaning system 16, from which the recovered toner may be dropped into a path to gate 20. Alternatively, a conventional or well-known blade cleaning system (per se, or with an added disturber brush) may be used, in which case, no vacuum system at all is needed for the cleaning system. See, e.g., Xerox Corporation U.S. Pat. Nos. 3,848,992; 3,740,789; 3,724,020; 3,724,019; 3,660,863; 3,634,077 or 3,552,850. The present system is not limited to any particular cleaning system.

The exemplary system includes a developer materials gate 20 operated by a solenoid 18 or other gate actuator, which is activated by the machine 10 controller 100 via control signal input or line 19. When the gate 20 is thus activated into its raised position [as shown in phantom in FIG. 2] all toner from cleaner 16 is deflected into the tube (or other purge path or toner transport path) 22 to purge therethrough into a purge container 24. [A waste toner bottle, sump, or the like, container or receptacle.] Purge container 24 may be slid out of the machine 10 on rails 24*a* or the like for removal and mailing-in for central materials recovery from its contents when it has filled [but it is not for immediate machine 10 reuse]. A full container sensor may be provided, as is known.

When gate 20 is activated into its illustrated opposite (lower) position, toner from cleaning station 16 is instead passed through a reclaim path (transport tube) 26 to recycle into the add-toner input unit 30 of developer unit 14, so that this toner may be reclaimed and reused along with (in partial savings of) new toner also being conventionally added there in unit 30 from its new-toner bottle 32. [New toner is provided on demand in a known manner, and less will be required in proportion to the amount replaced by said reclaim recycling.]

The exemplary operation of said exemplary apparatus will now be further described. The gate system 20 is selectably actuatable by control means 100, 18 between a first (lowered) gate position diverting marking materials from the cleaning system output 16*a* into reclaim path 26 on to the image development station 14; and a second (raised) gate 20 position directing all marking materials from the cleaning system 16 into the transport path 22 to purging dump 24. The control means 100, 18 maintains the gate system in the first (lowered) gate position when the imaging apparatus 10 is in the operating mode utilizing only the black marking material from developer station 14. The control 100 maintains the gate system 20 in the second (raised) gate position when the imaging apparatus 10 in the operating mode is utilizing colored marking materials from the first image development station 12. [That also includes operating modes using both materials, such as developing an image with both black and red areas or intermixtures thereof.] [These are operator or external computer mode image selections already stored in the controller 100 by that time, in order to turn on or off the respective developer units 12 and 14.]

However, that gate 20 switching per se does not fully prevent contamination by mixing of toners when the machine 10 is transitioning between these two different operating modes, since some colored toner will remain on the photoreceptor 11 and/or in the cleaning station 16 for several copy cycles after the change to black-only imaging mode. Thus, the control 100 here is preprogrammed with a purge cycle delay, delaying actuation of the gate 20 from said second gate position to said first gate position for a preset delay period after said imaging apparatus has stopped utilizing any colored marking from the colored image development station 12. This preset delay period is made sufficiently long to purge substantially, or effectively all, colored marking materials into purging dump 24, and to prevent those colored marking materials from developer unit 12 from passing through the reclaim path 26 to the development station 14.

For this purging delay, at least three to six images (but usually more) may be counted, or at least one or more photoreceptor belt 11 revolutions may be counted, or a corresponding conventional internal microprocessor preset clock time count delay may be used. This information is available from existing machine control data in the controller 100.

This preset image or photoreceptor evolution count or clock time for the purge cycle length will be determined and selected based on the volume and other purging time factors for the particular upstream (predecision gate) hardware. I.e., a copier or printer with a very large volume cleaning and exhaust system could require hundreds of copy cycles to purify the toner path. This time period can be empirically determined by testing the machine prototype. Also, a dark colored toner developer station can probably tolerate some limited colored toner contamination, more so than a light one, as further discussed below, so the purge cycle can be shorter.

Note that there is no such purge cycle delay required in switching from black to colored (or mixed colored and black) imaging in this example. The gate 20 may be immediately switched upon that mode change to begin immediate purging, assuming colored toner is not being recovered (see below).

While black toner is noted herein as used most and therefor the most cost-effective to recycle, it will be appreciated that in some systems or customer applications, another color toner may be the primary color used, and recycled in the same manner.

In the above-described embodiment, second [or any subsequent] colored toners are described in this first example as directed to a purging dump 26. However, it will be appreciated that these other toners also may optionally be recycled in a similar manner. This could be particularly desirable for a high volume (production)

full color machine. For example, by adding a similar additional purging cycle and a similar additional subsequent gate and reclaim path, such as gate 20' and recycle path 26' in the toner path 22 (shown in phantom in FIG. 2), the other (colored) toner or toners may be similarly redirected for reclaim recycling to their respective other developer station, such as 12. Such optional additional gates, reclaim loops and purge cycles are not excluded by the claims as filed. However, as noted above, the desired purging cycles may vary for different colored toners. For example, black toner image spots are more visible on bright color image areas, so it is more critical not to recycle black toner into such a color's developer unit. In contrast, a small amount of colored toner can be effectively masked in an otherwise black image. Or, in a system with plural superposed composite colored images, the underlying colors may be less contaminant sensitive.

It will be also appreciated that well known auger, wire coil, or the like toner transporting assistance means (note the herein-cited and other patents) may be variously used inside the toner transport conduits 14*a*, 26, and 22 here to ensure positive toner movement therealong.

While the embodiments disclosed herein are preferred, it will be appreciated from this teaching that various alternatives, modifications, variations or improvements therein may be made by those skilled in the art, which are intended to be encompassed by the following claims:

What is claimed is:

1. In a plural-color printer or copier imaging apparatus in which at least two different marking materials of at least first and second respective colors are respectively utilized for said imagings in at least first and second distinct image development stations, both in said imaging apparatus, and wherein said imaging apparatus also includes a cleaning system for removing said marking materials which are not fully utilized for said imaging, and a purging dump into which said marking materials removed by said cleaning system may be collected, and a transport path for transporting said marking materials between said cleaning system and said purging dump, the improvement comprising:

an automatically actuatable marking materials gate system operatively connecting with said cleaning system and said transport path to said purging dump, control means for said actuation of said gate system, a marking materials reclaim path operatively connecting between said gate system and said first image development station, said gate system being selectably actuatable by said control means between at least a first gate position diverting said marking materials from said cleaning system into said reclaim path to said first image development station, and a second gate position directing said marking materials from said cleaning system into said transport path to said purging dump, said control means maintaining said gate system in said second gate position when said imaging apparatus is utilizing said second marking material of said second color from said second image development station, and maintaining said gate system in said first gate position when said imaging apparatus is utilizing said first marking material of said first color from said first image development station, said control means having a purge cycle delay for delaying said actuation of said gate system from said second gate position to said first gate position for a preset delay period after said imaging apparatus is utilizing said first marking material of said first color from said first image development station, said preset delay period being sufficient to substantially purge said second marking material of said second color and to substantially prevent said second marking material of said second color from passing through said marking materials reclaim path to said first image development station.

2. The plural-color imaging apparatus of claim 1, wherein said first marking material is black.

3. The plural-color imaging apparatus of claim 1, in which said preset gate actuation purge cycle delay period of said control means corresponds to a counted preset plural number of said imagings made solely by said first image development station.

4. The plural-color imaging apparatus of claim 1, wherein said preset gate actuation purge cycle delay period of said control means is a time delay preset in accordance with a predetermined purging time for said imaging apparatus.

5. In a method of plural color imaging with a plural-color imaging apparatus in which at least two different marking materials of at least first and second respective colors are respectively utilized for said imagings in at least first and second image development stations, and wherein a common cleaning system captures said marking materials which are not utilized for said imagings, the improvement comprising the steps of;

selectably gating said marking materials from said cleaning system into a purging path or into a reclaim path returning said marking materials to said first image development station, including maintaining said gating of marking materials into said purging path when said imaging apparatus is utilizing said second marking material of said second color from said second image development station, further including maintaining said gating of marking materials into said reclaim path when said imaging apparatus is solely utilizing said first marking material of said first color from said first image development station, and controlling said gating to provide a purge cycle delay for delaying said gating from said purging path to said reclaim path for a preset delay period after said imaging apparatus begins solely utilizing said first marking material of said first color from said first image development station, said preset delay period being sufficient to substantially purge said second marking material of said second color into said purging-path and to prevent deleterious amounts of said second marking material of said second color from entering said reclaim path to said first image development station.

6. The plural-color imaging method of claim 5, wherein said first marking material is black.

7. The plural-color imaging method of claim 5, in which said preset purge cycle delay period corresponds to a count of a preset multiple number of said imagings made solely by said first image development station.

8. The plural-color imaging method of claim 5, wherein said preset gate actuation purge cycle delay period is a time delay preset in accordance with a predetermined purging time for said imaging apparatus.

* * * * *